US009163643B2

(12) United States Patent
Masutani

(10) Patent No.: US 9,163,643 B2
(45) Date of Patent: Oct. 20, 2015

(54) SUCTION CASING AND FLUID MACHINE

(75) Inventor: Jo Masutani, Takasago (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 1049 days.

(21) Appl. No.: 13/148,497

(22) PCT Filed: Feb. 16, 2010

(86) PCT No.: PCT/JP2010/000930

§ 371 (c)(1),
(2), (4) Date: Aug. 9, 2011

(87) PCT Pub. No.: WO2010/098032

PCT Pub. Date: Sep. 2, 2010

(65) Prior Publication Data

US 2011/0311356 A1 Dec. 22, 2011

(30) Foreign Application Priority Data

Feb. 27, 2009 (JP) ..... 2009-047187

(51) Int. Cl.
*F04D 1/06* (2006.01)
*F04D 29/70* (2006.01)
*F04D 29/44* (2006.01)

(52) U.S. Cl.
CPC ..... *F04D 29/701* (2013.01); *F04D 29/441* (2013.01)

(58) Field of Classification Search
CPC ... F04D 29/441; F04D 29/444; F04D 29/448; F04D 29/542; F04D 29/548
USPC ..... 415/184, 191, 199.2, 205, 206
See application file for complete search history.

(56) References Cited

U.S. PATENT DOCUMENTS

| | | | | |
|---|---|---|---|---|
| 7,559,742 | B2 * | 7/2009 | Inoue et al. | 415/184 |
| 2002/0192076 | A1 * | 12/2002 | Hansen et al. | 415/184 |
| 2003/0099544 | A1 * | 5/2003 | Brekke | 415/204 |

FOREIGN PATENT DOCUMENTS

| | | |
|---|---|---|
| EP | 1 593 854 | 11/2005 |
| JP | 2000-291593 | 10/2000 |
| JP | 2002-327700 | 11/2002 |
| JP | 2004-144029 | 5/2004 |
| JP | 2007-309154 | 11/2007 |

(Continued)

OTHER PUBLICATIONS

International Search Report issued May 18, 2010 in International (PCT) Application No. PCT/JP2010/000930.
Chinese Office Action issued Aug. 8, 2013 in corresponding Chinese Patent Application No. 201080009253.5 with English translation.

(Continued)

*Primary Examiner* — Nathaniel Wiehe
*Assistant Examiner* — Woody A Lee, Jr.
(74) *Attorney, Agent, or Firm* — Wenderoth, Lind & Ponack, L.L.P.

(57) ABSTRACT

A suction casing includes a suction nozzle that introduces a fluid from an outer circumferential side to an inner circumferential side in a radial direction; and a chamber that includes a substantially doughnut-shaped space in communication with an inside of the suction nozzle on the outer circumferential side and that guides the fluid, introduced from the suction nozzle, to an inlet opening portion opening in an axial direction and disposed in a substantially annular shape. The chamber is formed so that a radial width is narrower in a circumferential direction from a joint portion in communication with the suction nozzle to an opposite side across a central axis.

6 Claims, 7 Drawing Sheets

(56) References Cited

FOREIGN PATENT DOCUMENTS

| | | | | |
|---|---|---|---|---|
| SU | 1211419 | * | 9/1984 | ..... F04D 9/02 |
| SU | 1211419 | | 2/1986 | |

OTHER PUBLICATIONS

Written Opinion of the International Searching Authority issued May 18, 2010 in International (PCT) Application No. PCT/JP2010/000930 w/English translation.

* cited by examiner

SUCTION CASING AND FLUID MACHINE

TECHNICAL FIELD

The present invention relates to a suction casing that guides a fluid, which is introduced along a radial direction, so as to flow along an axial direction toward a substantially annular-shaped opening, and also relates to a fluid machine provided therewith.

Priority is claimed on Japanese Patent Application No. 2009-047187, filed on Feb. 27, 2009, the content of which is incorporated herein by reference.

BACKGROUND ART

In fluid machines such as compressors for use, for example, in pipelines and large turbo refrigerators, a fluid introduction portion that introduces a fluid is provided with a suction casing for supplying the fluid from the fluid introduction portion to the apparatus main unit entirely in the circumferential direction about the rotation axis. Such a suction casing includes, for example: a suction nozzle that introduces a fluid from an outer circumferential side to an inner circumferential side in the radial direction; and a circular flow passage formed in a doughnut shape in communication with the suction nozzle. The suction casing has a construction that introduces the fluid in the axial direction through the circular flow passage (for example, see Patent Document 1).

In the fluid machine as described above, a fluid is required to be uniformly supplied entirely in the circumferential direction of the suction casing in order to improve performance and suppress vibration. Therefore, a suction casing as shown in FIG. 7 and FIG. 8 is adopted. Namely, in a compressor 50 as shown in FIG. 7 and FIG. 8, a suction casing 51 includes: a suction nozzle 52; a chamber 53 formed in a doughnut shape in communication with the suction nozzle 52; and a suction flow passage 54 that is formed in a trumpet-like shape on an inner circumferential side of the chamber 53 and opens along an axial direction L in a part of an inner circumferential wall of the chamber 53. In such a suction casing 51, the suction flow passage 54 opens only in a part of the axial direction in the inner wall of the chamber 53. Therefore, a fluid F introduced from the suction nozzle 52, after having been filled in the chamber 53 entirely in the circumferential direction C, flows into the trumpet-shaped suction flow passage 54, and is then introduced to an apparatus main unit 55. As a result, it is possible to make the fluid more uniform in the circumferential direction C compared with the construction as disclosed in Patent Document 1.

Patent Document 1: Japanese Unexamined Patent Application, First Publication No. 2007-309154

However, even with the suction casing 51 shown in FIG. 7 and FIG. 8, some of the fluid F having been introduced from the suction nozzle 52 may flow directly into the suction flow passage 54 without circulating in the circumferential direction C in the chamber 53, and may be supplied to an impeller 55*a* on the apparatus main unit 55 side. Therefore, to make the fluid F uniform in the circumferential direction, it is required to make the chamber 53 larger in the axial direction, leading to a problem in that the fluid machine as a whole is made larger in the axial direction.

The present invention has been achieved in view of the aforementioned circumstances, and provides a suction casing and a fluid machine capable of introducing a fluid in the axial direction as one uniform in the circumferential direction while they are made smaller in the axial direction.

DISCLOSURE OF INVENTION

To solve the above problem, the present invention proposes the following.

A suction casing according to one aspect of the present invention includes: a suction nozzle that introduces a fluid from an outer circumferential side to an inner circumferential side in a radial direction; and a chamber that includes a substantially doughnut-shaped space in communication with an inside of the suction nozzle on the outer circumferential side and that guides the fluid, introduced from the suction nozzle, to an inlet opening portion opening in an axial direction and disposed in a substantially annular shape, in which the chamber is formed so that a radial width is narrower in a circumferential direction from a joint portion in communication with the suction nozzle to an opposite side across a central axis.

With this construction, the radial width of the chamber including a substantially doughnut-shaped space is formed so as to be narrower in the circumferential direction from the joint portion in communication with the suction nozzle to the opposite side across the central axis. Consequently, the fluid introduced from the suction nozzle is guided so as to be closer to the inlet opening portion in the radial direction as it flows along the circumferential direction from the joint portion side to the opposite side. This can promote the flow into the inlet opening portion on the side opposite to the joint portion. Therefore, it is possible to suppress the concentration of the fluid only on the joint portion side in the chamber. Furthermore, it is possible to cause the fluid to flow to the side opposite to the joint portion while the fluid is prevented from flowing directly into the inlet opening portion without flowing from the joint portion side to the side opposite to the joint portion. This can make the fluid uniform in the circumferential direction. Furthermore, because the shape in which the radial width is narrower along the circumferential direction makes it possible to make the fluid uniform in the circumferential direction, the dimension of the chamber in the axial direction can be made minimum.

The suction casing may further include a plurality of first partitioning blades provided in the chamber in the circumferential direction, which guide the fluid, having flowed in the chamber from the suction nozzle along the circumferential direction, to the inlet opening portion, and each of the first partitioning blades may be disposed so as to extend toward the inlet opening portion along the radial direction on the inner circumferential end side, and is also disposed so as to extend closer to the suction nozzle as extending closer to the outer circumferential end side.

With this construction, the fluid introduced from the suction nozzle into the chamber is guided to the inlet opening portion by the plurality of first partitioning blades that are provided in the circumferential direction and are disposed so as to extend toward the inlet opening portion on the inner circumferential end side along the radial direction. Here, the portions of the first partitioning blades located on the outer circumferential side are disposed so as to extend toward the suction nozzle as they are closer to the outer circumferential end. Thereby, also on the side opposite to the joint portion, it is possible to preferably guide the fluid, which flows from the joint portion side along the circumferential direction, to the inlet opening portion. As a result, it is possible to further promote the flow of the fluid in the circumferential direction from the joint portion side to the opposite side in the chamber, and hence, to make the fluid that is introduced to the inlet opening portion further uniform in the circumferential direction.

The suction casing may further include a second partitioning blade that is provided in the chamber, and that guides the fluid, introduced from the suction nozzle along the radial direction, so as to flow along the circumferential direction.

With this construction, the fluid, which has been introduced from the suction nozzle into the chamber along the radial direction, is guided along the circumferential direction by the second partitioning blade. Therefore, it is possible to further promote the flow of the fluid in the circumferential direction from the joint portion to the opposite side, and hence, to make the fluid that is introduced to the inlet opening portion further uniform in the circumferential direction.

The suction casing may further include a partitioning portion that defines an inside of the chamber in the circumferential direction on a side opposite to the joint portion of the chamber across the central axis.

With this construction, the inside of the chamber is defined in the circumferential direction by the partitioning portion on the side opposite to the joint portion. The fluid, which flows from the joint portion to the opposite side on one side in the circumferential direction, is restricted from passing the side opposite to the joint portion and then further flowing to the other side in the circumferential direction. Therefore, the branched flows of the fluid branched at the joint portion to both sides in the circumferential direction can be prevented from interfering each other. Furthermore, on the side opposite to the joint portion, the branched portions of the fluid are guided to the inlet opening portion. Therefore, it is possible to make the fluid that is introduced to the inlet opening portion further uniform in the circumferential direction.

The suction casing may further include: a casing main unit internally having a substantially doughnut-shaped hollow portion; and a fitting part that is detachably fitted onto an inner circumferential surface of the casing main unit to form a remaining space of the hollow portion as the chamber.

With this construction, at the time of assembly, it is possible to utilize the hollow portion, from which the fitting part is removed, to attach the internal structure for the apparatus main unit with ease. Furthermore, the fitting part is fitted onto the outer circumferential surface of the casing main unit, to thereby make it possible to easily form such a chamber as to have a radial width being narrower in the circumferential direction.

A fluid machine according to one aspect of the present invention includes: the suction casing; a rotary shaft rotatable about an axis of itself; an impeller in which the fluid is guided by the suction casing to an inlet opening portion disposed substantially annularly on one side in an axial direction, the impeller being a substantially disk-like member attached to the rotary shaft.

According to the fluid machine with this construction, provision of the aforementioned suction casing makes it possible to introduce the fluid uniformly in the circumferential direction. This makes it possible to improve the performance and suppress the vibration, and also to make the fluid machine as a whole smaller in the axial direction.

Advantageous Effects of the Invention

According to the suction casing of the present invention, it is possible to introduce the fluid in the axial direction as one uniform in the circumferential direction while making the suction casing smaller in the axial direction.

Furthermore, according to the fluid machine of the present invention, it is possible to improve the performance and suppress the vibration, and also to make the fluid machine as a whole smaller in the axial direction.

BEST MODE FOR CARRYING OUT THE INVENTION

Figure 1:
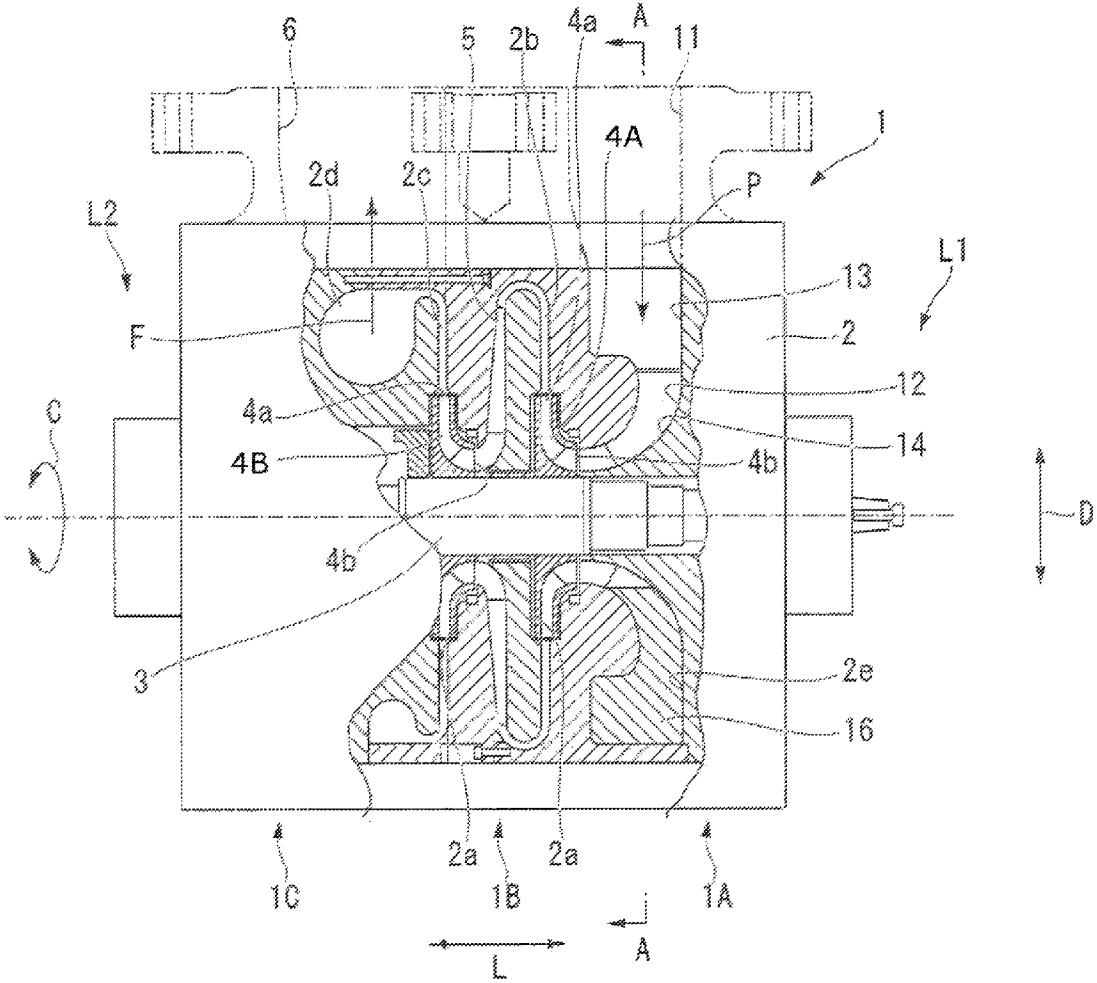
FIG. 1 is a partially cutaway side view showing a compressor of an embodiment of the present invention.
Figure 2:
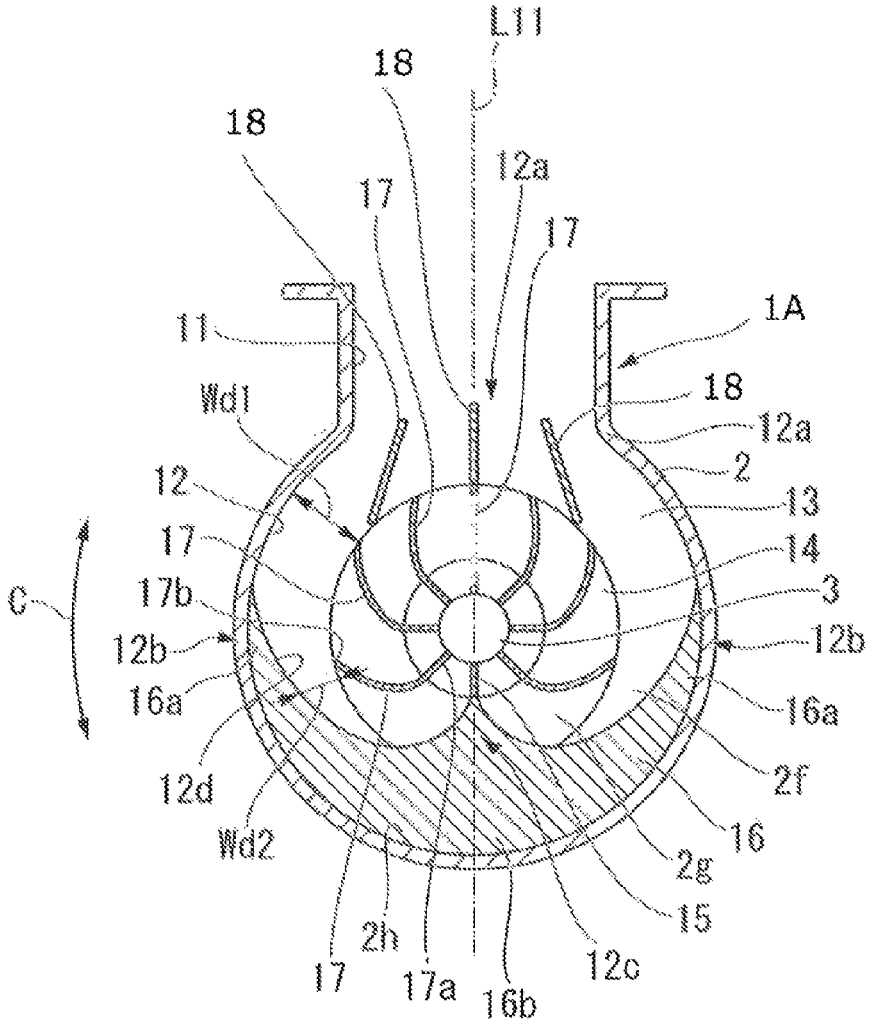
FIG. 2 is a cross-sectional view showing a suction casing of the embodiment of the present invention, that is, a cross-sectional view of FIG. 1 taken along the cutaway line A-A.

Hereunder is a description of an embodiment according to the present invention with reference to FIG. 1 and FIG. 2. As shown in FIG. 1, a compressor 1 as a fluid machine of the present embodiment includes: a suction casing 1A into which a fluid F to be compressed is introduced; an apparatus main unit 1B that compresses the fluid F introduced from the suction casing 1A; and a discharge casing 1C that sends out the fluid F compressed by the apparatus main unit 1B. Furthermore, the compressor 1 includes: a substantially cylindrical casing main unit 2; a rotary shaft 3 disposed inside the casing main unit 2; and substantially disk-like impellers 4A and 4B attached to the rotary shaft 3. The rotary shaft 3 is supported, rotatably about its own axis, at both of its ends by bearings (not shown in the figures) provided in the casing main unit 2.

In the apparatus main unit 1B, the rotary shaft 3 is provided with a plurality of impellers 4A and 4B in an axial direction L. In the casing main unit 2, a plurality of operation chambers 2*a* is provided in which the impellers 4A and 4B are contained on one-on-one basis. The impellers 4A and 4B have: an outlet opening portion 4*a* that opens to an outer circumferential side in its radial direction D; and an inlet opening portion 4*b* that opens to an upstream L1 side in the axial direction L.

Furthermore, in the casing main unit 2, a discharge passage 2*b* that guides a fluid F discharged from an impeller 4A on the upstream L1 side in the axial direction L to an impeller 4B on a downstream L2 side in the axial direction L is formed between the operation chambers 2*a* in which the impellers 4A and 4B are contained. The discharge passage 2*b* is formed annularly about the axis of the rotary shaft 3. In addition, the discharge passage 2*b* is formed in a substantially U shape in a cross-section of the rotary shaft 3 along the axial direction L, and guides the fluid F discharged from the outlet opening portion 4*a* of the impeller 4A on the upstream L1 side in the axial direction L to the inlet opening portion 4*b* of the impeller 4B on the downstream L2 side in the axial direction L. In the discharge passage 2*b*, return vanes 5 are disposed in a radial manner on the downstream L2 side in the axial direction L.

In the discharge casing 1C, the casing main unit 2 is provided with: a discharge passage 2*c* into which the fluid F discharged from the outlet opening portion 4*a* of the impeller 4B on the most downstream L2 side in the axial direction L; an annular scroll 2*d* in communication with the discharge passage 2*c*; and a discharge nozzle 6 in communication with the scroll 2*d*. The fluid F is discharged from the discharge nozzle 6 to the outer circumferential side in the radial direction D.

Next is a detailed description of the suction casing 1A. As shown in FIG. 1 and FIG. 2, the suction casing 1A includes: a suction nozzle 11 that introduces the fluid F from the outer circumferential side to the inner circumferential side in the radial direction D; and a chamber 12 that has a substantially doughnut-shaped space provided inside the casing main unit 2 and in communication with the suction nozzle 11 on the outer circumferential side. The chamber 12 is in communication with the inlet opening portion 4*b* of the impeller 4A located on the most upstream L1 side in the axial direction L. The suction nozzle 11 is provided in a manner protruding to the outer circumferential side of the casing main unit 2 in the radial direction D, and is communication with the outer circumferential side of the chamber 12.

In addition, the chamber 12 includes: a substantially annular introduction portion 13 disposed on the outer circumferential side in the radial direction D; and a substantially annular guide portion 14 that communicates the introduction portion 13 with the inlet opening portion 4*b* of the impeller 4A. In the cross-section along the axial direction L, the guide portion 14 is curved so as to be closer to the downstream L2 side in the axial direction L from the introduction portion 13 toward the inner circumferential side in the radial direction D, and thereby in communication with the inlet opening portion 4*b* of the impeller 4A. This makes it possible to cause the fluid F, which has been introduced into the introduction portion 13 through the suction nozzle 11, to circulate in the introduction portion 13 along the circumferential direction C, and also to be introduced into the guide portion 14, then gradually to the inner circumferential side in the radial direction D along the guide portion 14, and finally into the inlet opening portion 4*b* of the impeller 4A.

Here, as shown in FIG. 2, a radial width Wd1 of the introduction portion 13 is formed substantially the same from an upper portion 12*a*, which functions as a joint portion to which the suction nozzle 11 is joined, to side portions 12*b* which are substantially 90 degrees away from the upper portion 12*a* in the circumferential direction C about the rotary shaft 3. In the introduction portion 13, there is formed an outer circumferential surface 12*d* that curves from each side portion 12*b* to a lower portion 12*c* located at a position opposite to the upper portion 12*a* across the center of the rotary shaft 3 (at a position substantially 180 degrees away from the upper portion 12*a* in the circumferential direction C about the rotary shaft 3). A radial width Wd2 of the introduction portion 13 is smaller from the side portion 12*b* to the lower portion 12*c*. Furthermore, in the lower portion 12*c*, there is provided a partitioning portion 15 that internally defines the chamber 12 in the circumferential direction C. The outer circumferential surface 12*d* of the chamber 12 are formed in a curve toward the inner circumferential side in the radial direction D so as to continue into the partitioning portion 15.

In the present embodiment, the chamber 12 is formed of: a substantially doughnut-shaped hollow portion 2*e* formed in the casing main unit 2; and a fitting part 16 that is removably fitted into the hollow portion 2*e*. The hollow portion 2*e* has: a first portion 2*f* that corresponds to the introduction portion 13 of the chamber 12 and is formed in an annular shape; and a second portion 2*g* that corresponds to the guide portion 14 of the chamber 12. The second portion 2*g* has an annular shape, and curves so as to extend further toward the inner circumferential side in cross-section along the axial direction L as it extends further to the downstream L2 side in the axial direction L. The fitting part 16 is fitted in a range from the side portions 12*b* to the lower portion 12*c* of the chamber 12 on an outer circumferential surface 2*h* of the hollow portion 2*e*. The fitting part 16 is formed in a substantially crescent shape so as to be thicker from end portions 16*a*, which correspond to the side portions 12*b*, to a central portion 16*b*, which corresponds to the lower portion 12*c*. With the change in thickness of the fitting part 16, the radial width Wd2 of the introduction portion 13 is formed so as to be narrower from the side portions 12*b* to the lower portion 12*c* in the range from the side portions 12*b* to the lower portion 12*c* into which the fitting part 16 is fitted. Furthermore, the fitting part 16 is formed so as to continue into the partitioning portion 15.

At the time of manufacture, the casing main unit 2 may be made dividable along a plane in the hollow portion 2*e* orthogonal to the axial direction L, and the fitting part 16 may be fitted into the hollow portion 2*e* along the axial direction L. Alternatively, the casing main unit 2 and the fitting part 16 may be made dividable along the axial direction L, and the divided units of the fitting part 16 may be fitted into the corresponding divided units of the hollow portion 2*e*.

Furthermore, in the chamber 12, the guide portion 14 is provided with a plurality of first partitioning blades 17 in the circumferential direction C. The first partitioning blades 17 guide the fluid F, which flows through the introduction portion 13 in the circumferential direction C, toward the inlet opening portion 4*b*. The portions of the first partitioning blades 17 located on an inner circumferential end 17*a* side are disposed so as to extend toward the inlet opening portion 4*b* along the radial direction D. On the other hand, the portions of the first partitioning blades 17 located on an outer circumferential end 17*b* are disposed so as to extend closer to the suction nozzle 11 as they are closer to the outer circumferential end 17*b*. Therefore, the first partitioning blades 17 are different in shape according to their position in the circumferential direction C. Namely, in the upper portion 12*a* provided with the suction nozzle 11, the first partitioning blade 17 is formed in a linear shape in the radial direction D from the inner circumferential end 17*a* to the outer circumferential end 17*b*. In the side portions 12*b* and the lower portion 12*c*, the first partitioning blades 17 are formed in a curved manner so as to extend at first along the radial direction D and then toward the upper portion 12*a*, from the inner circumferential end 17*a* to the outer circumferential end 17*b*. Their curvature is greater from the side portion 12*b* to the lower portion 12*c*. In the present embodiment, the first partitioning blades 17 have been described as being provided on the guide portion 14 in the chamber 12. However, the first partitioning blades 17 may have a construction in which the outer circumferential end 17*b* extends to the introduction portion 13.

In the introduction portion 13 of the chamber 12, the upper portion 12*a* functioning as a joint portion that is joined to the suction nozzle 11 is provided with second partitioning blades 18 that guide the fluid F, which is introduced from the suction nozzle 11 along the radial direction D, so as to flow along the circumferential direction C. In the present embodiment, three second partitioning blades 18 are provided. The second partitioning blade 18 at the center is disposed in the radial direction D along a center line L11 of the suction nozzle 11, and continues into the first partitioning blade 17 located highest in the upper portion out of the first partitioning blades 17 (namely, the first partitioning blade 17 provided along the center line L11). The second partitioning blades 18 on both ends are disposed so as to be spaced further away from the upper portion 12*a* to the side portion 12*b*. The forms of the second partitioning blades 18 are not limited to those of the present embodiment. For example, more of them may be arranged, and they may have their upper ends extended into the inside of the suction nozzle 11.

Next is a description of the operation of the suction casing 1A of this embodiment. As shown in FIG. 1 and FIG. 2, in the suction casing 1A of the embodiment, the fluid F caused to flow from the outer circumferential side to the inner circumferential side in the radial direction D by the suction nozzle 11 flows into the introduction portion 13 via the upper portion 12*a* in communication with the chamber 12. Here, provision of the three second partitioning blades 18 makes it possible to guide the fluid F, which has flowed into the introduction portion 13, to both sides of the circumferential direction C, and hence to cause the fluid F to preferably flow along the circumferential direction C. Then, in the introduction portion 13, the fluid F flowing in the circumferential direction C flows into the guide portion 14 located on the inner circumferential side, and further flows to the inlet opening portion 4*b* of the impeller 4A.

Here, the radial width Wd of the introduction portion 13 of the chamber 12 is formed so as to be narrower along the circumferential direction C from the upper portion 12*a* to the lower portion 12*c* through the side portions 12*b*.

As a result, the fluid F introduced from the suction nozzle 11 is guided so as to be closer to the inlet opening portion 4*b* as it flows in the circumferential direction C from the upper portion 12*a* to the lower portion 12*c* through the side portions 12*b*. This can promote the flow of the fluid F into the inlet opening portion 4*b* of the impeller 4A through the guide portion 14 on the lower portion 12*c* side opposite to the upper portion 12*a* side. Therefore, it is possible to suppress the concentration of the fluid F only on the upper portion 12*a* side in the chamber 12. Furthermore, it is possible to suppress the production of a drift (imbalance of distribution in velocity and pressure) in the circumferential direction C resulting from the fluid F flowing from the upper portion 12*a* not through the side portions 12*b* and the lower portion 12*c* into but directly into the inlet opening portion 4*b* of the impeller 4A. Namely, in the suction casing 1A of the present invention, the fluid F can be flowed to the lower portion 12*c* side, making the fluid F uniform in the circumferential direction C. Furthermore, with the shape of the chamber 12 whose radial width Wd is narrower along the circumferential direction C, it is possible to make the fluid F uniform in the circumferential direction C, and hence, to make the dimension of the chamber 12 along the axial direction L minimum. Furthermore, the compressor 1 provided with the aforementioned suction casing 1A can be improved in performance and its vibration can be suppressed by the fluid F supplied to the apparatus main unit 1B being made uniform in the circumferential direction C. In addition, because the dimension of the suction casing 1A along the axial direction L can be made minimum as described above, the compressor 1 as a whole can be made smaller in the axial direction L. Therefore, it is possible to suppress its vibration further by making the span length of the rotary shaft 3 shorter.

In particular, the inside of the chamber 12 is defined in the circumferential direction C by the partitioning portion 15 at the lower portion 12*c* located on the opposite side of the upper portion 12*a* through which the fluid F is introduced from the suction nozzle 11. As a result, the fluid F flowing from the upper portion 12*a* to the lower portion 12*c* on one side in the circumferential direction C is restricted from passing the lower portion 12*c* into the other side in the circumferential direction C. Therefore, the branched flows of fluid F branched at the upper portion 12*a* to both sides in the circumferential direction C are prevented from passing the lower portion 12*c* to interfere each other. Furthermore, on the lower portion 12*c* side, each of the branched fluid F is guided to the inlet opening portion 4*b* of the impeller 4A. This makes it possible to make the fluid F that is introduced to the inlet opening portion 4*b* further uniform in the circumferential direction C. In the present embodiment, the outer circumferential surface 12*d* of the chamber 12 is formed in a manner curving toward the inner circumferential side in the radial direction D so as to continue into the partitioning portion 15 at the lower portion 12*c*. Therefore, it is possible to more smoothly guide the inflow of the fluid F at the lower portion 12*c* from the introduction portion 13 to the guide portion 14. Therefore, it is possible to make the fluid F that is introduced to the inlet opening portion 4*b* further uniform in the circumferential direction C.

As described above, the fluid F that has been introduced from the suction nozzle 11 into the chamber 12 along the radial direction D can be guided so as to flow along the circumferential direction C by the second partitioning blades 18. Therefore, it is possible to further promote the flow of the fluid F in the introduction portion 13 from the upper portion 12*a* side to the lower portion 12*c* side along the circumferential direction C. In addition, the guide portion 14 is provided with the first partitioning blades 17, which are disposed so as to extend closer to the suction nozzle 11 as they are closer to the outer circumferential end 17*b* side. As a result, also on the lower portion 12*c* side, it is possible to preferably guide the fluid F, which flows along the circumferential direction C from the upper portion 12*a*, to the inlet opening portion 4*b* of the impeller 4A through the guide portion 14. Therefore, in the chamber 12, it is possible to further promote the flow of the fluid F in the circumferential direction C from the upper portion 12*a* side to the lower portion 12*c* side. As described above, in the present embodiment, with the first partitioning blades 17 and the second partitioning blades 18, it is possible to make the fluid F, which is introduced to the inlet opening portion 4*b* of the impeller 4A, further uniformed in the circumferential direction C.

In the present embodiment, the chamber 12 is formed of: the hollow portion 2*e* formed in the casing main unit 2: and the fitting part 16 that is removably fitted onto the outer circumferential surface 2*h* of the hollow portion 2*e*. Therefore, in assembling the compressor 1, it is possible to utilize, with the fitting part 16 being unfitted, the hollow portion 2*e* of the casing main unit 2 to mount the internal structure onto the apparatus main unit 1B with ease. On the other hand, with the fitting part 16 being fitted onto the outer circumferential surface of the casing main unit 2, it is possible to easily form such a chamber 12 as to have a radial width Wd being narrower in the circumferential direction C.

Figure 3:
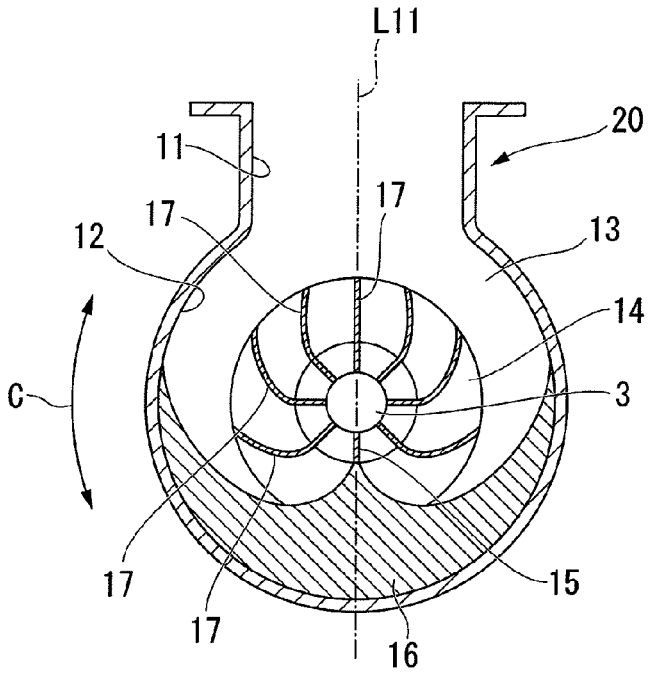
FIG. 3 is a cross-sectional view showing a suction casing of a first modification of the embodiment of the present invention.

FIG. 3 shows a first modification of the present embodiment. As shown in FIG. 3, a suction casing 20 of the modification does not include second partitioning blades 18. Also in such a suction casing 20, with the shape of the chamber 12 whose radial width Wd is narrower in the circumferential direction C, and also with the first partitioning blades 17, it is possible to make the fluid F, which is introduced to the inlet opening portion 4*b* of the impeller 4A, further uniform in the circumferential direction C, and hence, to make the dimension along the axial direction L minimum.

Figure 4:
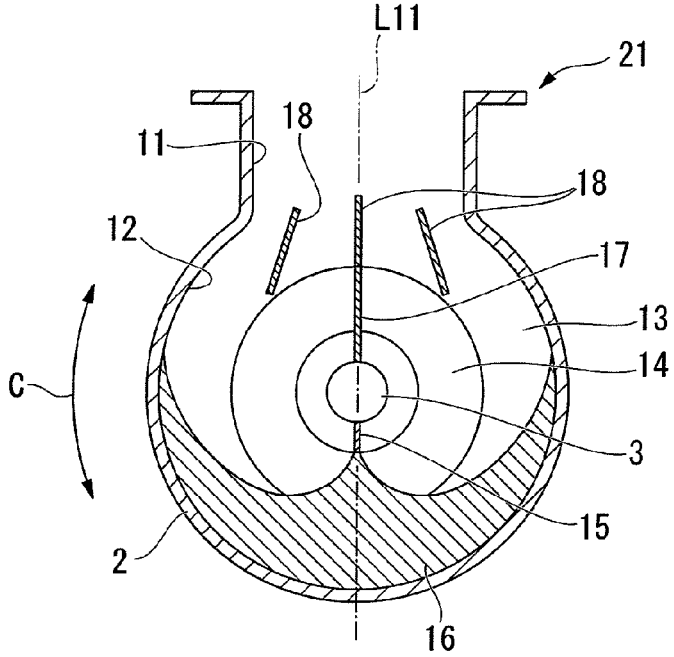
FIG. 4 is a cross-sectional view showing a suction casing of a second modification of the embodiment of the present invention.

FIG. 4 shows a second modification of the present embodiment. As shown in FIG. 4, in a suction casing 21 of this modification, only a single first partitioning blade 17 is provided that extends along the center line L11 of the suction nozzle 11. Also in such a suction casing 21, with the shape of the chamber 12 whose radial width Wd is narrower in the circumferential direction C, and also with the second partitioning blades 18, it is possible to make the fluid F, which is introduced to the inlet opening portion 4*b* of the impeller 4A, further uniform in the circumferential direction C, and hence, to make the dimension along the axial direction L minimum.

Figure 5:
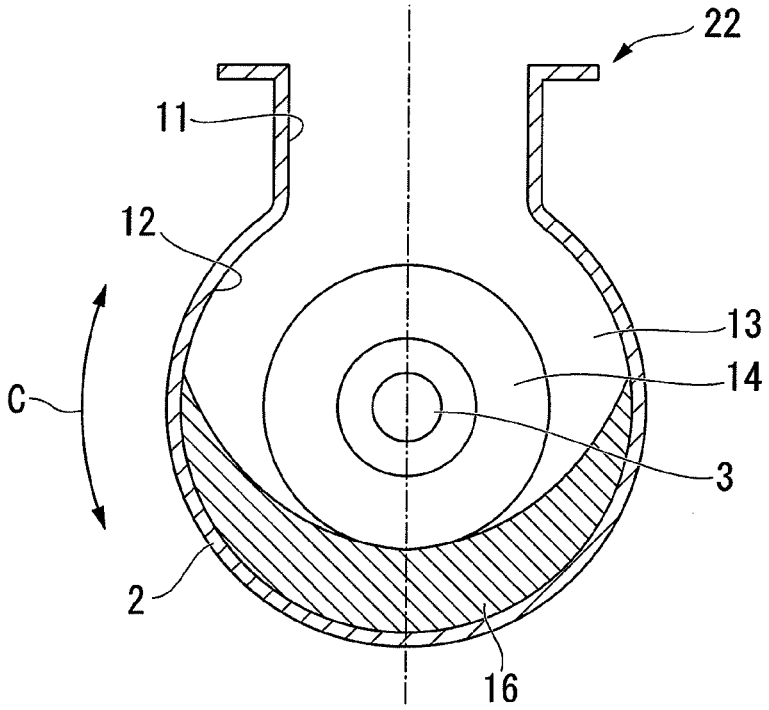
FIG. 5 is a cross-sectional view showing a suction casing of a third modification of the embodiment of the present invention.

FIG. 5 shows a third modification of the present embodiment. As shown in FIG. 5, a suction casing 22 of this modification has a construction without the first partitioning blades 17, the second partitioning blades 18, and the partitioning portion 15. Furthermore, although having a shape in which the radial width Wd is narrower in the circumferential direction C from the side portions 12*b* to the lower portion 12*c*, the chamber 12 does not have a shape that extends toward the inner circumferential side in the radial direction D at the lower portion 12*c*. Also in such a suction casing 21, with the shape of the chamber 12 whose radial width Wd is narrower in the circumferential direction C, it is possible to make the fluid F, which is introduced to the inlet opening portion 4*b* of the impeller 4A, further uniform in the circumferential direction C, and hence, to make the dimension along the axial direction L minimum.

Figure 6:
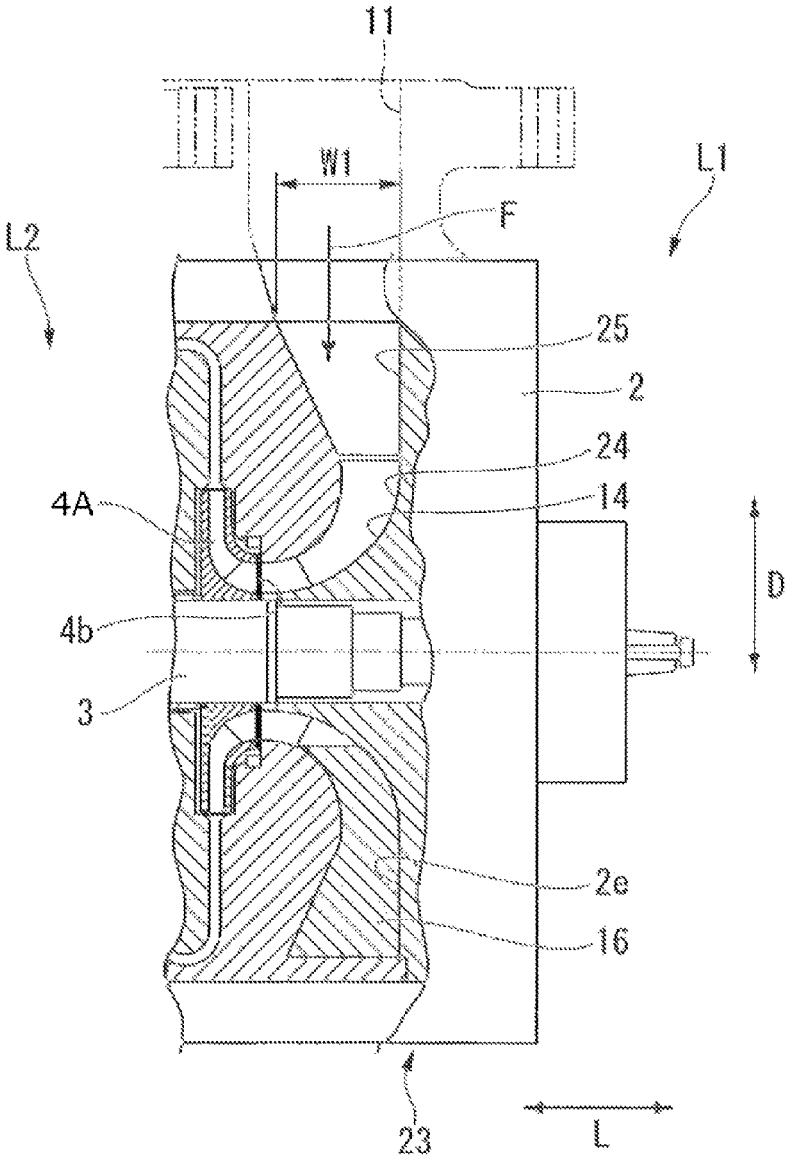
FIG. 6 is a partially cutaway side view showing a suction casing of a fourth modification of the embodiment of the present invention.
Figure 7:
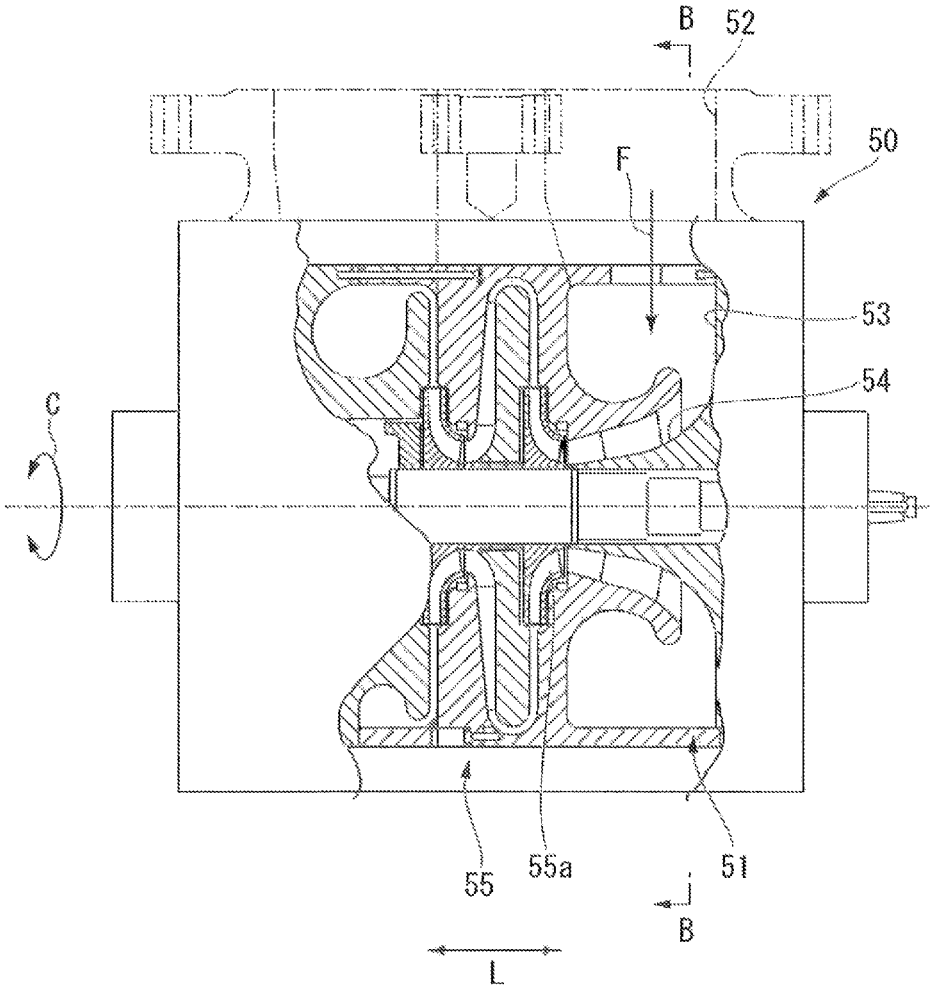
FIG. 7 (PRIOR ART)
FIG. 7 is a partially cutaway side view showing a conventional compressor.
Figure 8:
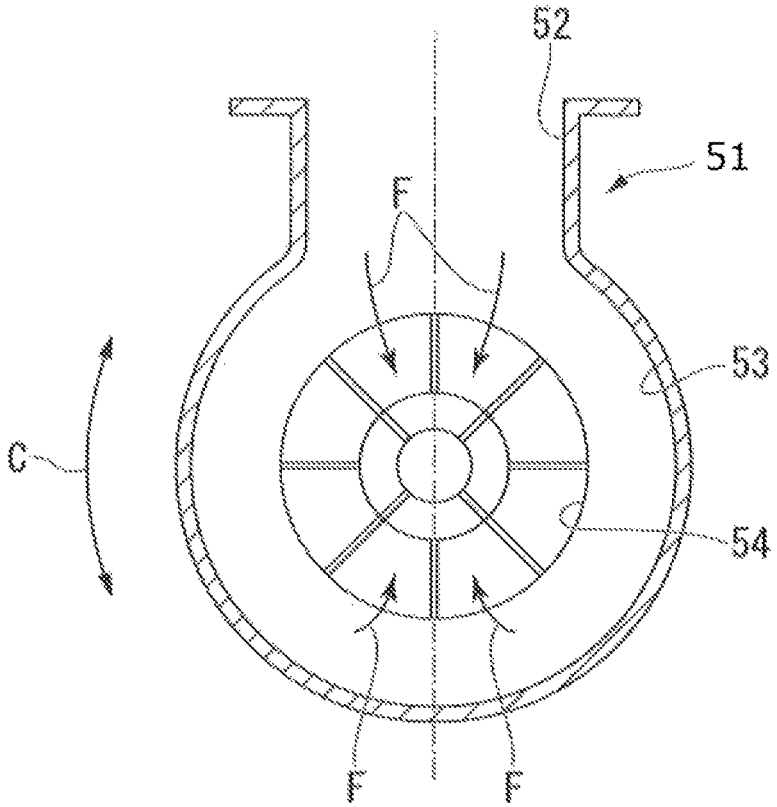
FIG. 8 (PRIOR ART)
FIG. 8 is a cross-sectional view showing the conventional suction casing, that is, a cross-sectional view of FIG. 6 taken along the cutaway line B-B.

FIG. 6 shows a fourth modification of the present embodiment. As shown in FIG. 6, a suction casing 23 of this modification is different from the suction casing 1A of the present embodiment in the shape of the introduction portion of the chamber. Namely, in an introduction portion 25 of a chamber 24 of this modification, the inner surface on the downstream L2 side in the axial direction L is inclined so as to be closer to the inner surface on the upstream L1 side in the axial direction L from the outer circumferential side to the inner circumferential side in the radial direction D. Therefore, in the introduction portion 25 of the modification, the width W1 in the axial direction is smaller from the outer circumferential side to the inner circumferential side in the radial direction D. In the suction casing 23 of the modification, with the shape of the introduction portion 25 as described above, it is possible to accelerate the flow of the fluid F that is introduced to the introduction portion 25 of the chamber 24 and then into the guide portion 14. This makes it possible to make the flow along the circumferential direction C further uniform.

While the embodiment of the present invention has been described in detail above with reference to the drawings, the specific structure of this embodiment is not limited to the above description. Design modifications and the like can be included insofar as they do not depart from the scope of the present invention.

In the above embodiment and modifications, the description has been for the case where the radial width of the chamber is set so as to be substantially the same from the upper portion to the side portions and also so as to be narrower from the side portions. However, the construction is not limited to this. For example, the radial width may be gradually narrower from the upper portion. Alternatively, the range in which the radial width is the same may be extended to the side portions and lower, and the radial width may be narrower only in the range on the lower portion side.

INDUSTRIAL APPLICABILITY

According to the suction casing of the present invention, the fluid can be introduced in the axial direction as one uniform in the circumferential direction while the suction casing is made smaller in the axial direction.

Furthermore, according to the fluid machine of the present invention, it is possible not only to improve the performance and suppress the vibration, but also to make the fluid machine as a whole smaller.

DESCRIPTION OF THE REFERENCE SYMBOLS

1: compressor (fluid machine)
1A, 20, 21, 22, 23: suction casing
2: casing main unit
2*e*: hollow portion
3: rotary shaft
4: impeller
4*b*: inlet opening portion
11: suction nozzle
12, 24: chamber
12*a*: upper portion (joint portion)
15: partitioning portion
16: fitting part
17: first partitioning blade
18: second partitioning blade
C: circumferential direction
D: radial direction
L: axial direction
F: fluid

The invention claimed is:

1. A suction casing comprising:

a casing main unit having a substantially donut-shaped hollow portion inside thereof;

a suction nozzle that introduces a fluid from an outer circumferential side to an inner circumferential side in a radial direction;

a chamber that comprises a substantially doughnut-shaped space in communication with an inside of the suction nozzle on the outer circumferential side and that guides the fluid, introduced from the suction nozzle, to an inlet opening portion opening in an axial direction and having a substantially annular shape; and a fitting part that is located in the chamber and is fitted into the chamber at a range of a lower portion from side portions of the chamber, to form a remaining space of the hollow portion as a flow path through which the fluid flows, wherein the chamber includes an introduction portion communicating with the inside of the suction nozzle, and a guide portion communicating with the introduction portion and the inlet opening portion, and a radial width of the introduction portion has a width that is constant from a top of the chamber, the top of the chamber being a joint portion to which the suction nozzle is joined, to both sides of the chamber, which are substantially 90 degrees away from the top of the chamber in a circumferential direction, and gradually narrows in the circumferential direction from an outer peripheral surface of the fitting part in the range of the lower portion from the side portions of the chamber.

2. The suction casing according to claim 1, further comprising:

a plurality of first partitioning blades provided in the chamber in the circumferential direction, which guide the fluid, having flowed in the chamber from the suction nozzle along the circumferential direction, to the inlet opening portion, wherein each of the first partitioning blades is disposed so as to extend toward the inlet opening portion along the radial direction at an inner circumferential end side, and is also disposed so as to extend closer to the suction nozzle at an outer circumferential end side.

3. The suction casing according to claim 1, further comprising a second partitioning blade that is provided in the chamber, and that guides the fluid, introduced from the suction nozzle along the radial direction, so as to flow along the circumferential direction.

4. The suction casing according to claim 1, further comprising a partitioning portion that defines an inside of the chamber in the circumferential direction on a side opposite to a joint portion of the chamber in communication with the suction nozzle across a central axis.

5. The suction casing according to claim 1, wherein the fitting part is detachably fitted onto an inner circumferential surface of the casing main unit.

6. A fluid machine, comprising:

the suction casing according to claim 1;

a rotary shaft rotatable about an axis of itself; and an impeller in which the fluid is guided by the suction casing to an inlet opening portion disposed substantially annularly on one side in the axial direction, the impeller being a substantially disk-shaped member attached to the rotary shaft.

* * * * *